US010557330B2

(12) United States Patent
Costa De Oliveira et al.

(10) Patent No.: US 10,557,330 B2
(45) Date of Patent: Feb. 11, 2020

(54) INTERCHANGEABLE WELLBORE CLEANING MODULES

(71) Applicant: Saudi Arabian Oil Company, Dhahran (SA)

(72) Inventors: Victor Carlos Costa De Oliveira, Dhahran (SA); Mario Augusto Rivas Martinez, Dhahran (SA); Khaled K. Abouelnaaj, Dhahran (SA); Ossama Sehsah, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 268 days.

(21) Appl. No.: 15/495,464

(22) Filed: Apr. 24, 2017

(65) Prior Publication Data

US 2018/0306005 A1 Oct. 25, 2018

(51) Int. Cl.
*E21B 37/04* (2006.01)
*E21B 41/00* (2006.01)
(Continued)

(52) U.S. Cl.
CPC ..... *E21B 37/04* (2013.01); *E21B 41/00* (2013.01); *E21B 47/00* (2013.01); *E21B 47/12* (2013.01)

(58) Field of Classification Search
CPC ..... E21B 37/00; E21B 37/02; E21B 37/04; E21B 37/045; E21B 37/08; E21B 37/10; E21B 17/006
(Continued)

(56) References Cited

U.S. PATENT DOCUMENTS 1,812,044 A 6/1931 Grant
3,335,801 A 8/1967 Wilsey
(Continued)

FOREIGN PATENT DOCUMENTS

CN 204177988 2/2015
EP 377234 10/1989
(Continued)

OTHER PUBLICATIONS

Offshore, "Completions Technology: Large monobore completions prevent high-volume gas well flow restrictions", Dec. 1, 2001, retrieved from the internet: • http://www.offshore-mag.com/articles/print/volume-61/issue-12/news/completions-technology-large-monobore-completions-prevent-high-volume-gas-well-flow-restrictions.html, 9 pages.
(Continued)

*Primary Examiner* — David Carroll
(74) *Attorney, Agent, or Firm* — Fish & Richardson P.C.

(57) ABSTRACT

A system for cleaning a wellbore can include a bottom hole assembly that is designed to be run downhole into a wellbore after the wellbore has been drilled and before the wellbore has been cleaned. A control sub-assembly is mounted on and carried by the bottom hole assembly. The control sub-assembly is designed to be positioned within the wellbore. Multiple cleaning sub-assemblies are interchangeably mounted on and carried by the bottom hole assembly. Each cleaning sub-assembly is designed to be positioned within the wellbore. The multiple cleaning sub-assemblies include at least two of the following sub-assemblies: a scraping sub-assembly that scrapes an interior of the wellbore, a brushing sub-assembly that brushes the interior of the wellbore, or a magnetic sub-assembly that magnetically captures debris within the wellbore.

17 Claims, 8 Drawing Sheets

(51) Int. Cl.
*E21B 47/00* (2012.01)
*E21B 47/12* (2012.01)

(58) Field of Classification Search
USPC ..... 166/170, 171, 172, 173, 174, 175, 176
See application file for complete search history.

(56) References Cited

U.S. PATENT DOCUMENTS 3,557,875 A 1/1971 Solum et al.
4,058,163 A 11/1977 Yandell
4,384,625 A 5/1983 Roper et al.
4,399,873 A 8/1983 Lindsey, Jr.
4,458,761 A 7/1984 Van Vreeswyk
4,482,014 A 11/1984 Allwin et al.
4,646,842 A 3/1987 Arnold et al.
4,674,569 A 6/1987 Revils et al.
4,681,159 A 7/1987 Allwin et al.
4,693,328 A 9/1987 Furse et al.
4,852,654 A 8/1989 Buckner
4,855,820 A 8/1989 Barbour
4,944,348 A 7/1990 Whiteley et al.
4,993,493 A 2/1991 Arnold
5,152,342 A 10/1992 Rankin et al.
5,390,742 A 2/1995 Dines et al.
5,947,213 A 9/1999 Angle
6,009,948 A 1/2000 Flanders et al.
RE36,556 E 2/2000 Smith
6,152,221 A 11/2000 Carmicheal et al.
6,163,257 A 12/2000 Tracy
6,234,250 B1 5/2001 Green et al.
6,378,628 B1 4/2002 McGuire et al.
6,527,066 B1 3/2003 Rives
6,550,534 B2 4/2003 Brett
6,577,244 B1 6/2003 Clark et al.
6,662,110 B1 12/2003 Bargach et al.
6,684,953 B2 2/2004 Sonnier
6,691,779 B1 2/2004 Sezginer et al.
6,739,398 B1 5/2004 Yokley et al.
6,752,216 B2 6/2004 Coon
6,873,267 B1 3/2005 Tubel et al.
6,899,178 B2 5/2005 Tubel
6,938,698 B2 9/2005 Coronado
7,219,730 B2 5/2007 Tilton et al.
7,228,902 B2 6/2007 Oppelt
7,243,735 B2 7/2007 Koederitz et al.
7,252,152 B2 8/2007 LoGiudice et al.
7,278,492 B2 10/2007 Braddick
7,419,001 B2 9/2008 Broussard
7,581,440 B2 9/2009 Meek
7,654,334 B2 2/2010 Manson
7,665,537 B2 2/2010 Patel et al.
7,677,303 B2 3/2010 Coronado
7,938,192 B2 5/2011 Rytlewski
7,940,302 B2 5/2011 Mehrotra et al.
8,028,767 B2 10/2011 Radford et al.
8,102,238 B2 1/2012 Golander et al.
8,191,635 B2 6/2012 Buske et al.
8,237,585 B2 8/2012 Zimmerman
8,334,775 B2 12/2012 Tapp et al.
8,424,605 B1 4/2013 Schultz et al.
8,448,724 B2 5/2013 Buske et al.
8,469,084 B2 6/2013 Clark et al.
8,528,668 B2 9/2013 Rasheed
8,540,035 B2 9/2013 Xu et al.
8,750,513 B2 6/2014 Renkis
8,789,585 B2 7/2014 Leising et al.
8,800,655 B1 8/2014 Bailey
8,833,472 B2 9/2014 Hay
8,919,431 B2 12/2014 Lott
8,925,213 B2 1/2015 Sallwasser
8,991,489 B2 3/2015 Redlinger et al.
9,051,792 B2 6/2015 Herberg et al.
9,091,148 B2 7/2015 Moffitt et al.
9,121,255 B2 9/2015 Themig et al.
9,140,100 B2 9/2015 Daccord et al.
9,157,294 B2 10/2015 Kleppa et al.
9,187,959 B2 11/2015 Treviranus et al.
9,208,676 B2 12/2015 Fadell et al.
9,341,027 B2 5/2016 Radford et al.
9,494,003 B1 11/2016 Carr
9,506,318 B1 11/2016 Brunet
9,546,536 B2 1/2017 Schultz et al.
2002/0148607 A1 10/2002 Pabst
2003/0001753 A1 1/2003 Cernocky et al.
2004/0060741 A1 4/2004 Shipalesky et al.
2004/0156264 A1 8/2004 Gardner et al.
2005/0273302 A1 12/2005 Huang et al.
2006/0081375 A1 4/2006 Ruttley
2006/0086497 A1 4/2006 Ohmer et al.
2006/0107061 A1 5/2006 Holovacs
2006/0260799 A1 11/2006 Broussard
2006/0290528 A1 12/2006 MacPherson et al.
2007/0057811 A1 3/2007 Mehta
2007/0107911 A1 5/2007 Miller et al.
2007/0187112 A1 8/2007 Eddison et al.
2007/0261855 A1 11/2007 Brunet
2008/0041631 A1 2/2008 Vail, III
2008/0115574 A1 5/2008 Meek
2009/0045974 A1 2/2009 Patel
2009/0050333 A1 2/2009 Smith
2009/0114448 A1 5/2009 Laird et al.
2009/0223670 A1 9/2009 Snider
2009/0289808 A1 11/2009 Prammer
2009/0301723 A1* 12/2009 Gray ..... E21B 23/00 166/301
2010/0097205 A1 4/2010 Script
2010/0101786 A1 4/2010 Lovell et al.
2010/0212891 A1 8/2010 Stewart et al.
2010/0212900 A1 8/2010 Eddison et al.
2010/0212901 A1 8/2010 Buytaert
2010/0258297 A1* 10/2010 Lynde ..... E21B 37/00 166/105.1
2010/0258298 A1 10/2010 Lynde et al.
2010/0282511 A1 11/2010 Maranuk et al.
2011/0067884 A1 3/2011 Burleson et al.
2011/0073329 A1 3/2011 Clemens et al.
2011/0127044 A1 6/2011 Radford et al.
2011/0147014 A1 6/2011 Chen et al.
2011/0240302 A1 10/2011 Coludrovich, III
2011/0266004 A1 11/2011 Hallundbaek et al.
2012/0085540 A1 4/2012 Heijnen
2012/0175135 A1 7/2012 Dyer et al.
2012/0211229 A1* 8/2012 Fielder ..... E21B 37/00 166/311
2012/0241154 A1 9/2012 Zhou
2012/0247767 A1 10/2012 Themig et al.
2012/0307051 A1 12/2012 Welter
2012/0312560 A1 12/2012 Bahr et al.
2013/0128697 A1 5/2013 Contant
2013/0153245 A1* 6/2013 Knobloch ..... E21B 27/00 166/381
2014/0060844 A1* 3/2014 Barbour ..... E21B 37/00 166/311
2014/0083769 A1 3/2014 Moriarty et al.
2014/0090898 A1 4/2014 Moriarty et al.
2014/0126330 A1 5/2014 Shampine et al.
2014/0139681 A1 5/2014 Jones, Jr. et al.
2014/0166367 A1 6/2014 Campbell et al.
2014/0172306 A1 6/2014 Brannigan
2014/0208847 A1 7/2014 Baranov
2014/0308203 A1 10/2014 Sheinberg et al.
2015/0027706 A1 1/2015 Symms
2015/0090459 A1 4/2015 Cain et al.
2015/0152713 A1 6/2015 Garcia et al.
2015/0176362 A1 6/2015 Prieto et al.
2015/0267500 A1 9/2015 Van Dongen et al.
2015/0308203 A1 10/2015 Lewis
2016/0160578 A1 6/2016 Lee
2016/0215612 A1 7/2016 Morrow
2016/0230508 A1 8/2016 Jensen
2016/0237764 A1 8/2016 Jellison et al.
2016/0237768 A1 8/2016 Jamison et al.
2016/0356152 A1 12/2016 Croux

(56) References Cited

U.S. PATENT DOCUMENTS

| | | | | |
|---|---|---|---|---|
| 2017/0067318 | A1* | 3/2017 | Haugland | E21B 37/02 |
| 2017/0074071 | A1 | 3/2017 | Tzallas et al. | |
| 2018/0030810 | A1 | 2/2018 | Saldanha | |

FOREIGN PATENT DOCUMENTS

| | | |
|---|---|---|
| EP | 618345 | 10/1994 |
| EP | 2692982 | 5/2014 |
| EP | 2835493 | 2/2015 |
| GB | 2157743 | 10/1985 |
| GB | 2261238 | 12/1993 |
| GB | 2460096 | 11/2009 |
| GB | 2470762 | 12/2010 |
| WO | 2003058545 | 7/2003 |
| WO | 2011038170 | 3/2011 |
| WO | 2011095600 | 8/2011 |
| WO | 2011159890 | 12/2011 |

OTHER PUBLICATIONS

Engineers Edge—ACME Stub Threads Size Designation Table Chart, retrieved from the internet at: http://www.engineersedge.com/hardware/acme-stub-thread.htm, retrieved Feb. 27, 2017, 2 pages.

Engineering Innovation Worldwide, TIW XPAK Liner Hanger System brochure, 2015 TIW Corporation, Houston TX , TIW0001D Jun. 2015, retrieved form the internet at: http://www.tiwoiltools.com/Images/Interior/downloads/tiw_xpak_brochure.pdf, 4 pages.

Mi Swaco: A Schlumberger Company, "Intelligent Fluids Monitoring System," available on or before Mar. 11, 2015, [retrieved May 1, 2018] retrieved from URL: <https://www.slb.com/resources/other_resources/brochures/miswaco/intelligent_fluids_monitoring_brochure.aspx>, 8 pages.

International Search Report and Written Opinion issued in International Application No. PCT/US2018/028174 dated Jul. 24, 2018, 24 pages.

* cited by examiner

INTERCHANGEABLE WELLBORE CLEANING MODULES

TECHNICAL FIELD

This disclosure relates to wellbore cleaning.

BACKGROUND

Wellbores can be drilled into geologic formations for a variety of reasons, such as hydrocarbon production, fluid injection, water production, or any other reason. Once a wellbore has been formed, it can be prepared for completion. Preparation for completion can include cleaning the walls of the wellbore, casing, liner, or a combination. Cleaning can be necessary due to debris falling downhole or loose material existing within the wellbore. Such issues can make completing a well costlier or more difficult.

SUMMARY

This present disclosure describes technologies relating to interchangeable wellbore cleaning modules.

In a general implementation, a system for cleaning a wellbore can include a bottom hole assembly that is designed to be run downhole into a wellbore after the wellbore has been drilled and before the wellbore has been cleaned. A control sub-assembly is mounted on and carried by the bottom hole assembly. The control sub-assembly is designed to be positioned within the wellbore. Multiple cleaning sub-assemblies are interchangeably mounted on and carried by the bottom hole assembly. Each cleaning sub-assembly is designed to be positioned within the wellbore. The multiple cleaning sub-assemblies include at least two of the following sub-assemblies: a scraping sub-assembly that scrapes an interior of the wellbore, a brushing sub-assembly that brushes the interior of the wellbore, or a magnetic sub-assembly that magnetically captures debris within the wellbore.

In an aspect combinable with the general implementation, the wellbore can include an open hole, cased, or lined wellbore.

In another aspect combinable with any of the previous aspects, the control sub-assembly can include one or more processors. A computer-readable medium stores instructions executable by the one or more processors to perform operations. For example, cleaning instructions to perform cleaning operations within the wellbore are received from a surface of the wellbore. In another example, at least a portion of the cleaning instructions are transmitted to at least one of the cleaning sub-assemblies.

In another aspect combinable with any of the previous aspects, the operations can further include receiving, from at least one of the plurality of cleaning sub-assemblies, status signals representing a cleaning status of the at least one of the plurality of cleaning sub-assemblies; and transmitting, to the surface of the wellbore, the status signals.

In another aspect combinable with any of the previous aspects, the status signals can include a state of a cleaning sub-assembly. The state can include either an on state or an off state, and a hydraulic pressure of the cleaning sub-assembly.

In another aspect combinable with any of the previous aspects, the system can further include one or more transmitters at the surface of the wellbore. The one or more transmitters can transmit the cleaning instructions to the one or more processors. One or more receivers at the surface of the wellbore can also be included. The one or more receivers can receive the status signals from the one or more processors.

In another aspect combinable with any of the previous aspects, the one or more transmitters and the one or more receivers are can communicate wirelessly with the one or more processors.

In another aspect combinable with any of the previous aspects, the system can further include one or more repeaters that can be positioned between the surface and the bottom hole assembly within the wellbore. The one or more repeaters can boost a strength of a wireless signal between the one or more transmitters or the one or more receivers and the one or more processors.

In another aspect combinable with any of the previous aspects, the control sub-assembly further includes a power source that can be positioned within the wellbore. The power source can be operatively coupled to the one or more processors and can provide operating power to the one or more processors.

In another aspect combinable with any of the previous aspects, the power source can be a wireless, stand-alone power source.

In another aspect combinable with any of the previous aspects, the system further includes a smart sub-assembly capable of receiving, from at least one of the cleaning sub-assemblies, status signals representing a cleaning status of the at least one of the plurality of cleaning sub-assemblies.

In another aspect combinable with any of the previous aspects each of the plurality of cleaning sub-assemblies can include a hydraulic power unit operatively coupled to the one or more processors. The hydraulic power unit can receive at least the portion of the cleaning instructions from the one or more processors. A cleaning tool can be operatively coupled to the hydraulic power unit. The hydraulic power unit can mechanically activate the cleaning tool. The cleaning tool is can implement a cleaning operation within the wellbore responsive to being mechanically activated by the hydraulic power unit.

In another aspect combinable with any of the previous aspects, the hydraulic power unit can include a hydraulic pump fluidically connected to the cleaning tool. The hydraulic pump can supply hydraulic fluid at a pressure sufficient to activate the cleaning tool.

In a general implementation, a first method of cleaning a wellbore includes receiving, by a control sub-assembly deployed within a wellbore and from a surface of the wellbore, cleaning instructions to perform cleaning operations within the wellbore. At least a portion of the cleaning instructions are transmitted by the control assembly to at least one of a plurality of cleaning sub-assemblies. The cleaning sub-assemblies include at least two of the following: a scraping sub-assembly that can scrape an interior of the wellbore, a brushing sub-assembly that can brush the interior of the wellbore, or a magnetic sub-assembly that can magnetically capture debris within the wellbore. Each of the cleaning sub-assemblies includes a cleaning tool that can clean within the wellbore. A respective cleaning tool is activated by the at least one of the plurality of cleaning sub-assemblies to clean within the wellbore.

In an aspect combinable with the general implementation of the first method, status signals representing a cleaning status of the at least one of the cleaning sub-assemblies can be transmitted from at least one of the cleaning sub-assemblies to the control assembly. The status signals can be received by the control assembly from the at least one of the cleaning sub-assemblies.

In another aspect combinable with any of the previous aspects of the first method, the status signals are transmitted from the at least one of the plurality of cleaning sub-assemblies, by the control assembly, to the surface of the wellbore.

In another aspect combinable with any of the previous aspects of the first method, each cleaning sub-assembly can include a respective hydraulic power unit that includes a hydraulic pump. Activating the respective cleaning tool, by the at least one of the cleaning sub-assemblies, to clean within the wellbore, can include pumping, by the hydraulic pump, hydraulic fluid to mechanically activate the respective cleaning tool.

In a general implementation, a second method of cleaning a wellbore includes forming a bottom hole assembly that is designed to be deployed in a wellbore to clean the wellbore, by assembling a control assembly with one or more processors and a computer-readable medium storing instructions executable by the one or more processors to clean the wellbore, and at least one of a scraping sub-assembly that scrapes an interior of the wellbore, a brushing sub-assembly that brushes the interior of the wellbore, or a magnetic sub-assembly that magnetically capture debris within the wellbore. the bottom hole assembly is deployed in the wellbore. the control assembly is controlled from a surface of the wellbore and using wireless signals to activate at least one of the scraping sub-assembly: the brushing sub-assembly, or the magnetic sub-assembly to clean the wellbore.

In an aspect combinable with the general implementation of the second method, at least two of the cleaning sub-assemblies, the scraping sub-assembly, the brushing sub-assembly, and the magnetic sub-assembly, can be assembled to form the bottom hole assembly.

In another aspect combinable with any of the previous aspects of the second method, the scraping sub-assembly, the brushing sub-assembly and the magnetic sub-assembly can be assembled to form the bottom hole assembly.

In another aspect combinable with any of the previous aspects of the second method, status signals representing a status of cleaning operations can be received by the control assembly and from the at least one of the scraping sub-assembly, the brushing sub-assembly or the magnetic sub-assembly. The status signals can be wirelessly transmitted by the control assembly to the surface of the wellbore.

In another aspect combinable with any of the previous aspects of the second method, the status signals can include a state of the at least one of the scraping sub-assembly, the brushing sub-assembly, or the magnetic sub-assembly. The state can include either an on state or an off state, and a hydraulic pressure of the at least one of the scraping sub-assembly, the brushing sub-assembly, or the magnetic sub-assembly.

The details of one or more implementations of the subject matter described in this specification are set forth in the accompanying drawings and the following description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Before a wellbore can be completed, the wellbore must be cleaned. Cleaning the wellbore involves removing loose debris from the wall of the wellbore and increasing the uniformity of the wellbore wall. Such cleaning can at least partially prevent sections of the wellbore from collapsing during the completion process and can improve the quality of cementing jobs. If a wellbore is not properly cleaned, then the wellbore could collapse during the completion process and need to be re-drilled. Such a repair takes a significant amount of time and expense to perform.

There are several types of tools that can be used to clean a wellbore. Often times, multiple passes need to be made so that different types of tools can be used to ensure the wellbore is properly prepared for completions. Such tools can include scrapers, brushes, magnets, or any other cleaning tool. Cleaning a wellbore can take multiple trips with a variety of tools and can take considerable time and effort. In some instances, after the well has been completed, the internal walls of a casing or liner 105 can also need cleaning.

This specification describes a system that can be attached to a bottom hole assembly (BHA) and is designed to clean the wellbore without removing the BHA from the wellbore. The system can include a control module and at least one of the following cleaning modules: a scraping module, a brushing module, or a magnetic module. The cleaning module(s) are individually controlled by the control module. The control module is able to communicate with a topside facility via a wireless connection, such as a radio frequency connection or mud pulse communication. Each module can contain its own battery pack and can be actuated multiple times while within the wellbore. In some implementations, the control module may communicate or be powered by a wired connection to a topside facility. Each cleaning module is able to send diagnostics to the control module which can then relay the diagnostics to a topside facility The system can be deployed either while drilling or after drilling operations. If deployed while drilling, a dedicated clean out run is not required.

Figure 1:
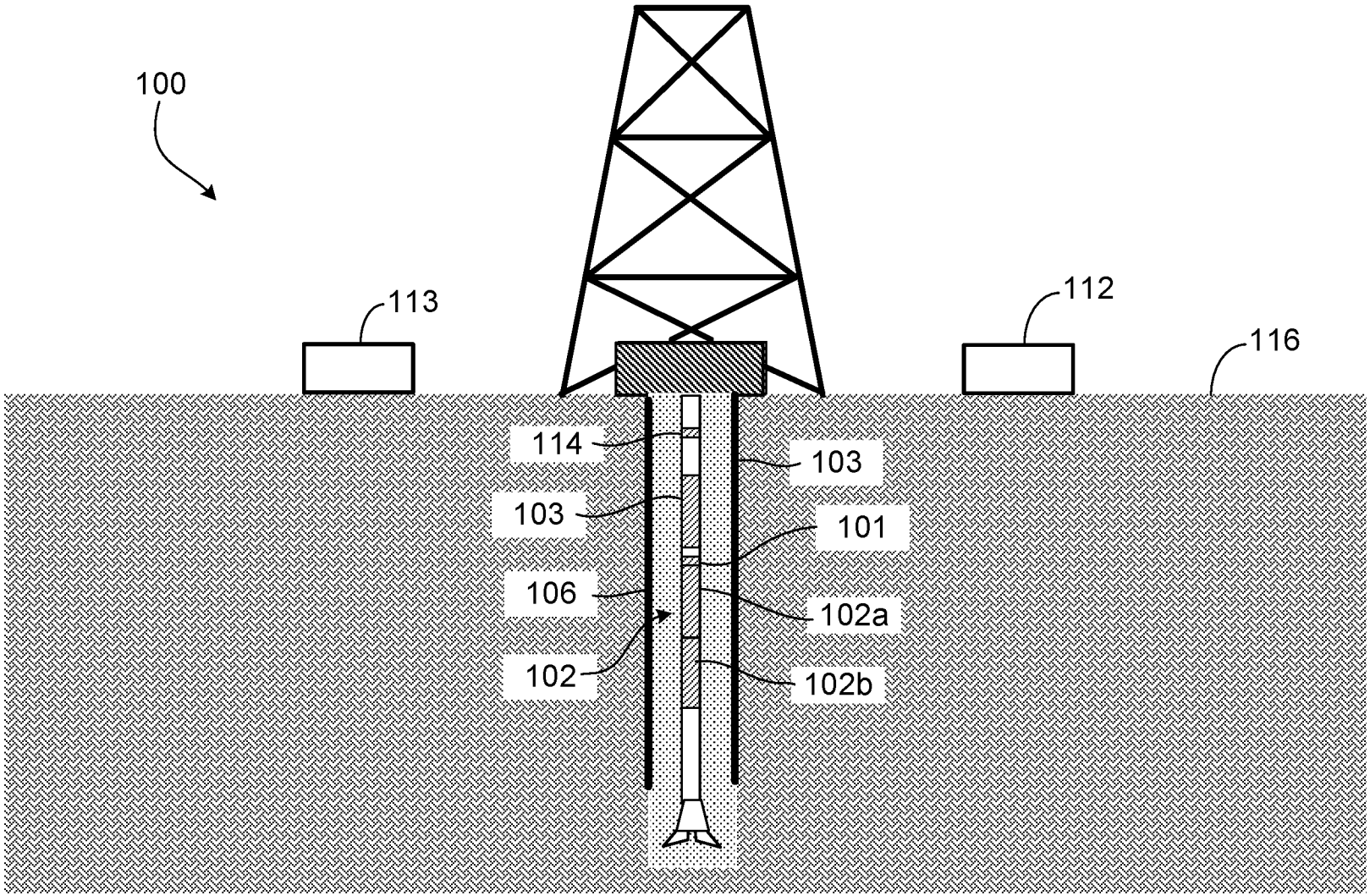
FIG. 1 is a side cross-sectional view of an example wellbore being drilled.

FIG. 1 shows an example wellbore cleaning system 100 being utilized in a wellbore 106. The wellbore cleaning system 100 can include a BHA 102 that can be run downhole into the wellbore 106 after the wellbore 106 has been drilled and before the wellbore 106 has been cleaned. In some implementations, the BHA 102 can be included on an active drilling string to clean the wellbore during drilling operations. In some implementations, the BHA 102 can be utilized after drilling operations have been completed. The BHA 102 includes a control sub-assembly 101 mounted on and carried by the BHA 102. The control sub-assembly 101 is designed to be positioned within the wellbore 106 and can handle any shock-loads, corrosive chemicals, or any other potential downhole hazards. The BHA also includes multiple cleaning sub-assemblies that can be interchangeably mounted on and carried by the BHA. Each cleaning sub-assembly can be positioned within the wellbore. In some implementations, the BHA can include two different cleaning sub-assemblies, such as a first sub-assembly 102*a* and a second sub-assembly 102*b*. Details on the different types of cleaning sub-assemblies are described later within this specification.

The cleaning system 100 can also include one or more transmitters 112 at the surface 116 of the wellbore 106. The one or more transmitters 112 can transmit cleaning instructions to the control sub-assembly 101. In addition to the transmitters 112, one or more receivers 113 can also be positioned at the surface 116 of the wellbore 106. The one or more receivers 113 can receive one or more status signals from the control sub-assembly 101. Each of the one or more transmitters 112 and the one or more receivers 113 can communicate wirelessly with the control sub-assembly 101. In some implementations, the wireless communication can include radio frequency communication, such as Wi-Fi. In some implementations, the cleaning system 100 can also include one or more repeaters 114 that can be positioned between the surface 116 and the BHA 102 within the wellbore 106. The repeaters 114 can boost a strength of a wireless signal between the one or more transmitters 112 or the one or more receivers 113 and the control sub-assembly 101. Details of the control sub-assembly 101 are described later within this specification. The cleaning system 100 can be used in vertical, deviated, and horizontal wellbores. In some implementations, the cleaning system 100 can include a smart sub 103 that can receive status signals of the BHA 102 and transmit instructions to the BHA 102. In such an implementation, data received from the BHA 102 can be stored in the smart sub 103 and can be retrieved after the smart sub is returned to the topside facility.

Figure 2C:
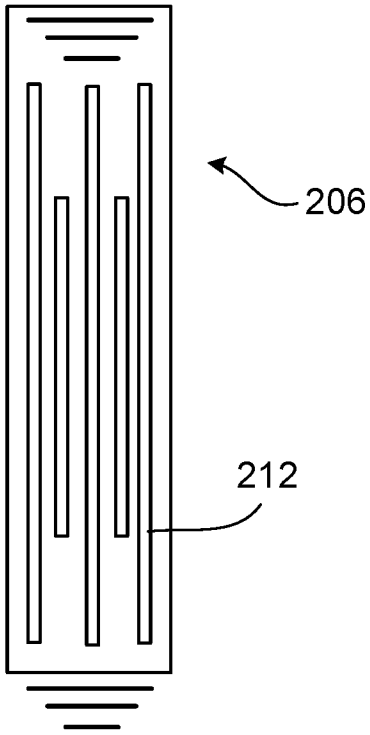
FIGS. 2A-2C are side views of examples of individual interchangeable modules.
Figure 2B:
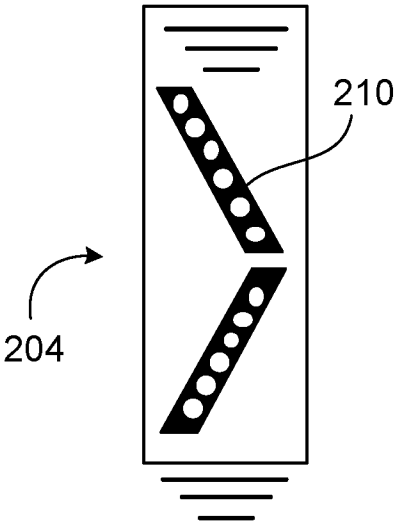
Figure 2A:
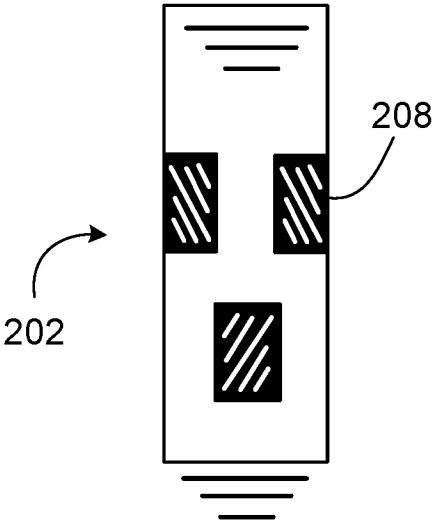

FIGS. 2A-2C show different example cleaning sub-assemblies. In some implementations, at least one of the cleaning sub-assemblies can include a scraping sub-assembly 202, which includes one or more scrapers 208 that are designed to scrape an interior of the wellbore 106. The scraping sub-assembly 202 could be considered the "coarse" cleaning sub-assembly. That is, the scraper can be the first step in cleaning the wellbore 106 and can result in the largest quantity of material compared to the other described cleaning-sub-assemblies. The scrapers 208 can be retractable within the scraping sub-assembly 202. The scrapers 208 can include blades, blocks, or other sturdy, abrasive geometries that allow for sufficient material removal. The scrapers 208 work by extending radially from the scraping sub-assembly 202 and at least partially contact the wall of the wellbore 106. In some implementations, the scraping sub-assembly 202 can include a respective hydraulic power unit that include a hydraulic pump used to extend the scrapers 208. Such an implementation is described later in this specification.

In some implementations, at least one of the cleaning sub-assemblies can include a brushing sub-assembly 204, which includes one or more brushes 210 that are designed to brush the interior of the wellbore. The brushing sub-assembly 204 could be considered the "fine" cleaning sub-assembly. That is, the brush can be used in a later cleaning step than the scraping sub-assembly 202 and can result in less material loss than the scraping sub-assembly 202. The brushes 210 can include bristles, needles, or other flexible, abrasive geometries arranged in any arrangement that allows for sufficient material removal. The brushes 210 work by extending radially from the brushing sub-assembly 204 and at least partially contact the wall of the wellbore 106. The brushes 210 can be retractable within the brushing sub-assembly 204. In some implementations, the brushing sub-assembly 204 can include a respective hydraulic power unit that includes a hydraulic pump used to extend the brushes 210. Such an implementation is described later in this specification.

In some implementations, at least one of the cleaning sub-assemblies can include a magnetic sub-assembly 206, which includes one or more electromagnetic bars 212 that are designed to magnetically capture debris within the wellbore. Debris can include drill bit fragments, nuts, bolts, or other tool components that have become deposited within the wellbore. The electromagnetic bars 212 can be remotely activated and de-activated as needed by applying a current to the electromagnetic bars. The applied current creates a magnetic field that draws any ferrous debris to the outer surface of the magnetic sub-assembly 206. The electromagnetic bars 212 can remain energized while the tool is pulled from the wellbore 106 to the topside facility to retain all of the collected ferrous debris.

The scraping sub-assembly 202, the brushing sub-assembly 204, and the magnetic sub-assembly 206 can be assembled to the BHA 102 with one, two, or all three sub-assemblies. For example, the scraping sub-assembly 202 can be utilized as the first sub-assembly 102*a* and the brushing sub-assembly 204 can be utilized as the second sub-assembly 102*b*. In some implementations, the brushing sub-assembly 204 can be utilized as the first sub-assembly 102*a* and the magnetic sub-assembly 206 can be utilized as the second sub-assembly 102*b*. In some implementations, all three sub-assemblies can be used. For example, the scraping sub-assembly 202 can be utilized as the first sub-assembly 102*a*, the brushing sub-assembly 204 can be utilized as the second sub-assembly 102*b*, and the magnetic sub-assembly 206 can be utilized as a third sub-assembly (not shown). In some implementations, two of the same cleaning sub-assembly can be assembled to the BHA 102. For example, the scraping sub-assembly 204 can be utilize for both the first sub-assembly 102*a* and the second sub assembly 102*b*. In some implementations, the brushing sub-assembly can be utilized as both the first sub-assembly 102*a* and the second sub assembly 102*b*. In some implementations, the magnetic sub-assembly 206 can be utilized as both the first sub-assembly 102*a* and the second sub assembly 102*b*.

Figure 3:
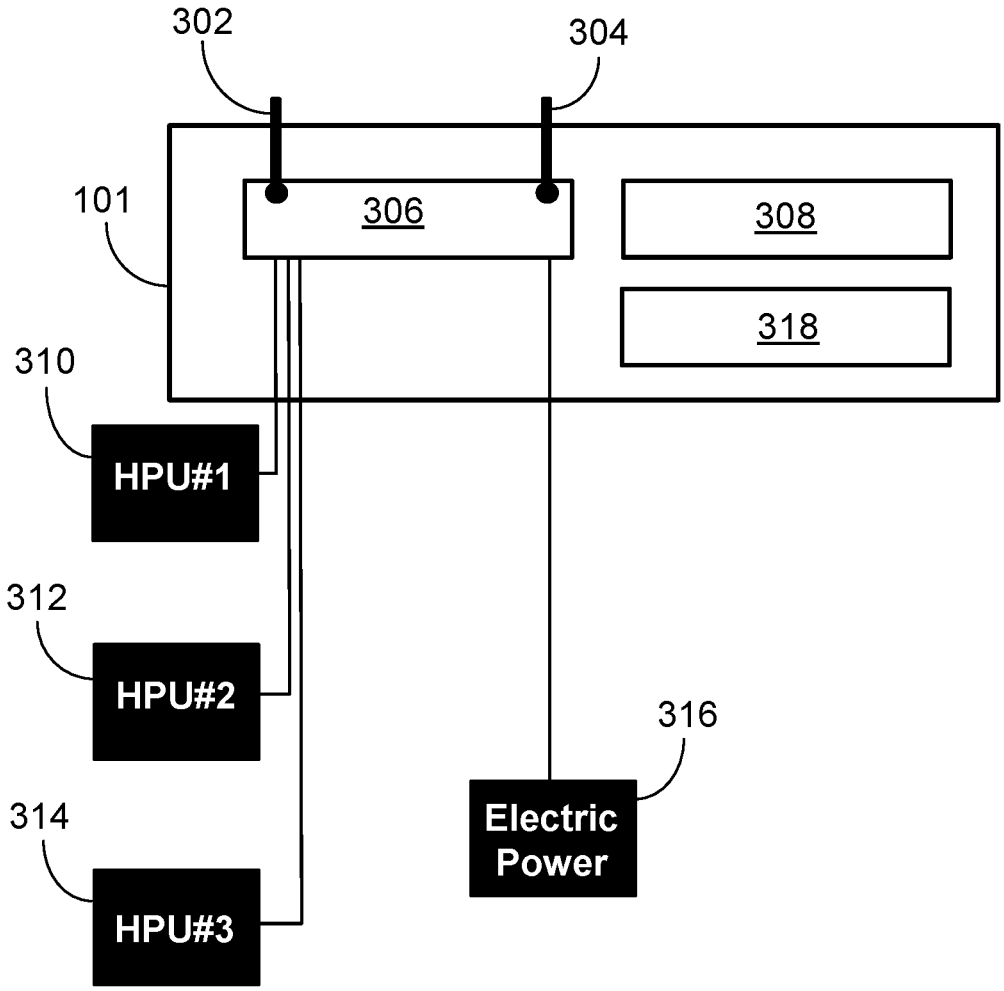
FIG. 3 shows a block diagram of an example control system.

FIG. 3 shows a detailed block diagram of the control sub-assembly 101. The control sub-assembly 101 can include one or more processors 306 and a computer-readable medium 318 storing instructions executable by the one or more processors 306 to perform operations. The control sub-assembly 101 can also include a transmitter 302 and receiver 304 that can be used to receive, from the surface of the wellbore, cleaning instructions to perform cleaning operations within the wellbore, and transmit, to at least one of the cleaning sub-assemblies, at least a portion of the cleaning instructions. The receiver 304 can also receive, from at least one of the cleaning sub-assemblies, status signals representing a cleaning status of the at least one of the cleaning sub-assemblies. The transmitter 302 can also transmit the status signals to the surface 116 of the wellbore 106. The status signals can include a state of a cleaning sub-assembly (such as an "on" state or an "off" state), a hydraulic pressure of the cleaning sub-assembly, or any other statuses of the sub-assembly. In some implementations, each individual cleaning sub-assembly can communicate wirelessly with the control module, hydraulically with the control module, wired with the control module, or a combination of any of the aforementioned methods.

The control sub-assembly also includes a power source 308 that can be positioned within the wellbore. The power source 308 can be operatively coupled to the one or more processors 306 and can provide operating power to the one or more processors 306. In some implementations, the power source can be a stand-alone power source positioned within the wellbore 106, such as a lithium ion battery. The wellbore cleaning system 100 can include one or more hydraulic power units, such as a first hydraulic power unit 310, a second hydraulic power unit 312, or a third hydraulic power unit 314, operatively coupled to the one or more processors 306. Any of the hydraulic power units can receive at least a portion of a set of cleaning instructions from the one or more processors 306. The hydraulic power units may receive instructions to change states ("on" command or "off" command) of the hydraulic pump, set a target pressure for the hydraulic pump, or any other command that can be executed by the hydraulic power unit. In some implementations, the different hydraulic power units may be interconnected to allow fluidic communication between each hydraulic power unit. The interconnection can allow a hydraulic power unit to control multiple cleaning sub-assemblies in the event of a hydraulic power unit failure. In some implementations, each of the cleaning modules can include a separate control module to facilitate communications with the control sub-assembly 101. The one or more processors 306 can also be coupled to an electrical power source 316 that can send electrical power to a cleaning module.

Figure 4B:
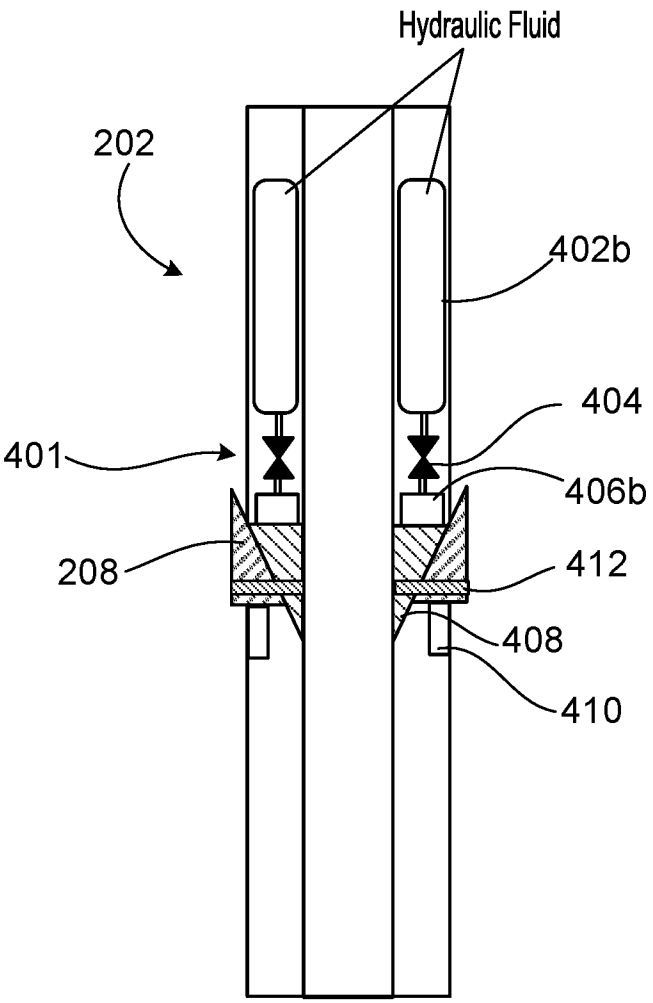
FIGS. 4A-4B show a side cross sectional view of an example scraper module.
Figure 4A:
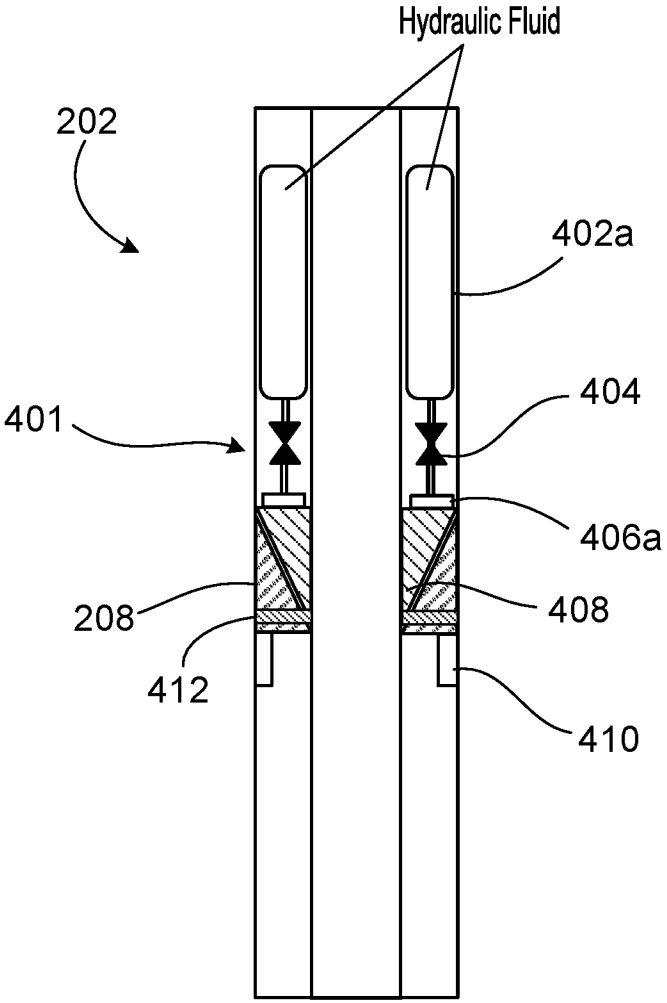

FIGS. 4A-4B show an example cross-sectional view of an example scraping sub-assembly 202 in various stages of operation. In FIG. 4A, the scraping sub-assembly 202 is in a deactivated mode, while in FIG. 4B, the scraping module 202 is in an activated mode. The scraping sub-assembly 202 includes a hydraulic power unit 401 operatively coupled to the control sub-assembly 101. The hydraulic power unit 401 can act as one of the hydraulic power units previously described, such as the first hydraulic power unit 310. The hydraulic power unit 401 can receive at least a portion of the cleaning instructions from the control sub-assembly 101. Portions of the cleaning instructions can include changing states of the hydraulic pump, changing an output pressure of the hydraulic pump, changing position of an actuate-able tool, or any other command that can be executed by the hydraulic power unit. The scrapers 208 can be operatively coupled to the hydraulic power unit 401, that is, the hydraulic power unit 401 can mechanically activate the scrapping tool to begin a cleaning operation within the wellbore 106 responsive to being activated by the control sub-assembly 101 For example, the hydraulic power unit 401 itself can include hydraulic pump 404 fluidically connected to the scrapers 208. The hydraulic pump 404 can supply hydraulic fluid, such as the hydraulic fluid stored in a full reservoir 402*a*, at a pressure sufficient to activate the scraping sub-assembly 202. To activate the scraping sub-assembly 202, the hydraulic power unit 401 can cause the scrapers 208 to extend radially outward from the scraping sub-assembly 202 and towards the wall of the wellbore 106. The scraping sub-assembly 202 can also include sensors 410 to relay information back to the control sub-assembly 101, such as hydraulic pressure or scraper 208 position.

Once the hydraulic power unit 401 has received a signal to activate the scraping sub-assembly 202, the hydraulic pump 404 moves hydraulic fluid from a full hydraulic reservoir 402*a* to an unexpanded expansion member 406*a*. The unexpanded expansion member 406*a* begins to expand and become expanded expansion member 406*b*. Similarly, the full hydraulic reservoir 402*a* becomes the depleted hydraulic reservoir 402*b* during the activation of the scraping sub-assembly 202. That is, activating at least one of the cleaning sub-assemblies, such as the scraping sub-assembly 202, includes pumping hydraulic fluid to mechanically activate the respective cleaning tool with the hydraulic pump 404. The expanded expansion member 406*b* moves a wedged mandrel 408 towards the scrapers 208. The wedge shaped mandrel causes the scrapers 208 to extend radially outward from the scraping sub-assembly 202 and towards the wall of the wellbore 106. The hydraulic pump 404 can include a check-valve that prevents back-flow from the expanded expansion member 406*b* to the depleted hydraulic reservoir 402*b*. In some implementations, the hydraulic power unit 401 can include one or more pressure sensors to measure a pressure of the hydraulic fluid. The pressure value detected by the one or more pressure sensors can be sent to the controller sub-assembly 101. The controller sub-assembly 101 can then transmit the pressure value to the surface 116. Once scraping operations are completed, the control sub-assembly 101 can send a signal to the hydraulic pump 404 to pump hydraulic fluid from the expanded expansion member back into the depleted hydraulic fluid reservoir. The scraping sub-assembly 202 can include a retraction device, such as a spring 412, to return the mandrel 408 and scrapers 208 back into the retracted position once the hydraulic fluid has been removed from the expanded expansion member 406*b*. The expansion member can include a bladder, a piston, or any other expandable actuation device. In some implementations, the hydraulic power unit 401 may be fluidically connected to a separate hydraulic power unit in another cleaning sub-assembly. Such a connection allows for a single hydraulic power unit to control multiple cleaning sub-assemblies in the event of a failure of one of the hydraulic power units, such as hydraulic power unit 401.

Figure 5B:
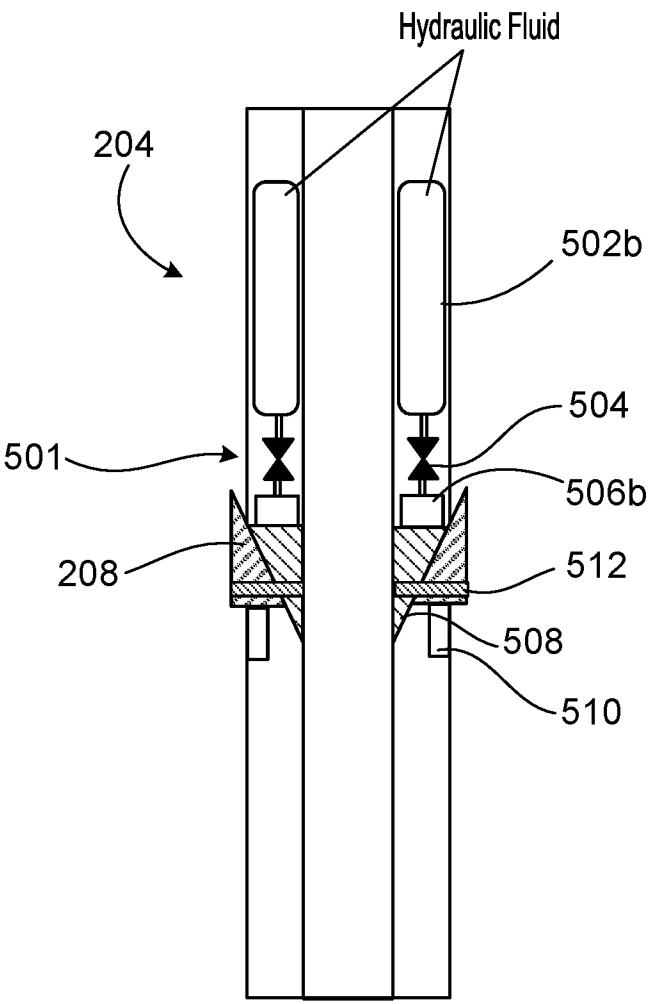
FIGS. 5A-5B show a side cross sectional view of an example brush module.
Figure 5A:
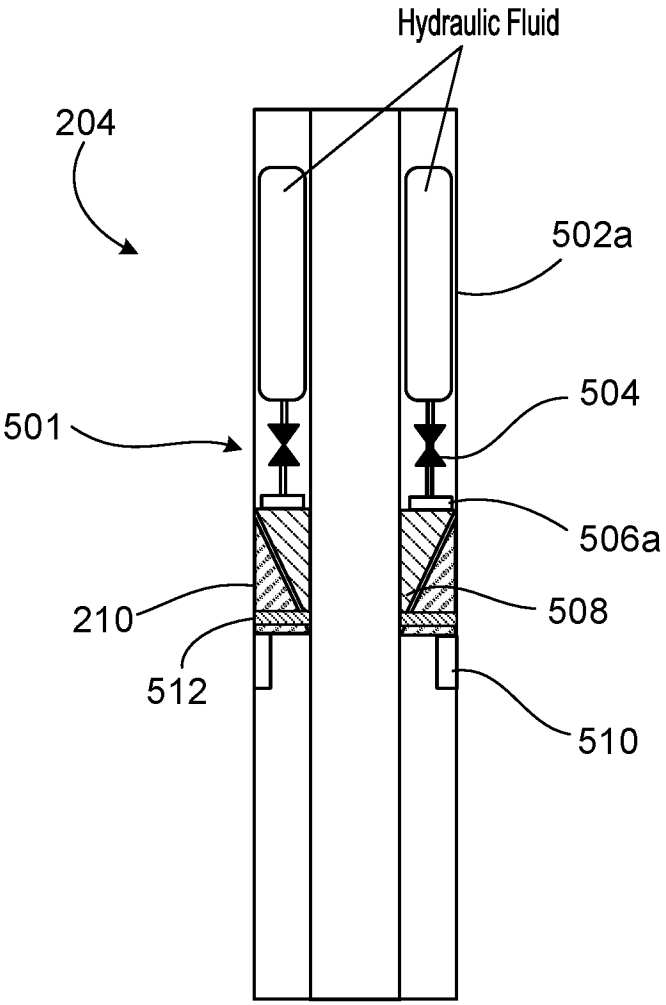

FIGS. 5A-5B show an example cross-sectional view of an example brushing sub-assembly 204 in various stages of operation. In FIG. 5A, the brushing sub-assembly 204 is in a deactivated mode, while in FIG. 5B, the brushing sub-assembly 204 is in an activated mode. The brushing sub-assembly 204 includes a hydraulic power unit 501 operatively coupled to the control sub-assembly 101. The hydraulic power unit 501 can act as one of the hydraulic power units previously described, such as the second hydraulic power unit 312. The hydraulic power unit 501 can receive at least a portion of the cleaning instructions from the control sub-assembly 101. Portions of the cleaning instructions can include changing states of the hydraulic pump, changing an output pressure of the hydraulic pump, changing position of an actuate-able tool, or any other command that can be executed by the hydraulic power unit. The scraping tool can be operatively coupled to the hydraulic power unit 501, that is, the hydraulic power unit 501 can mechanically activate the scraping tool to begin a cleaning operation within the wellbore 106 responsive to being mechanically activated by the hydraulic power unit 501. For example, the hydraulic power unit 501 may cause the brushes 210 to extend radially outward from the brushing sub-assembly 204 and towards the wall of the wellbore 106. The brushing sub-assembly 204 can also include sensors 510 to relay back information to the control sub-assembly 101, such as hydraulic pressure or brushes 210 position.

Once the hydraulic power unit 501 has received a signal to activate the brushing sub-assembly 204, the hydraulic pump 504 moves hydraulic fluid from a full hydraulic reservoir 502*a* to an unexpanded expansion member 506*a*. The unexpanded expansion member 506*a* begins to expand and become expanded expansion member 506*b*. Similarly, the full hydraulic reservoir 502*a* becomes the depleted hydraulic reservoir 502*b* during the activation of the brushing sub-assembly 204. That is, activating at least one of the cleaning sub-assemblies, such as the brushing sub-assembly 204, includes pumping hydraulic fluid to mechanically activate the respective brushes 210 with the hydraulic pump 504. The expanded expansion member 506*b* moves a wedged mandrel 508 towards the brushes 210. The wedge shaped mandrel 408 causes the brushes 210 to extend radially outward from the brushing sub-assembly 204 and towards the wall of the wellbore 106. Once scraping operations are completed, the control sub-assembly 101 can send a signal to the hydraulic pump to pump hydraulic fluid from the expanded expansion member back into the depleted hydraulic fluid reservoir. The brushing sub-assembly 204 can include a retraction device, such as a spring 512, to return the mandrel 508 and brushes 210 back into the retracted position once the hydraulic fluid has been removed from the expanded expandable member 506*b*. In some implementations, the hydraulic power unit 501 may be fluidically connected to a separate hydraulic power unit in another cleaning sub-assembly. Such a connection allows for a single hydraulic power unit to control multiple cleaning sub-assemblies in the event of a failure of one of the hydraulic power units, such as hydraulic power unit 501.

Figure 6:
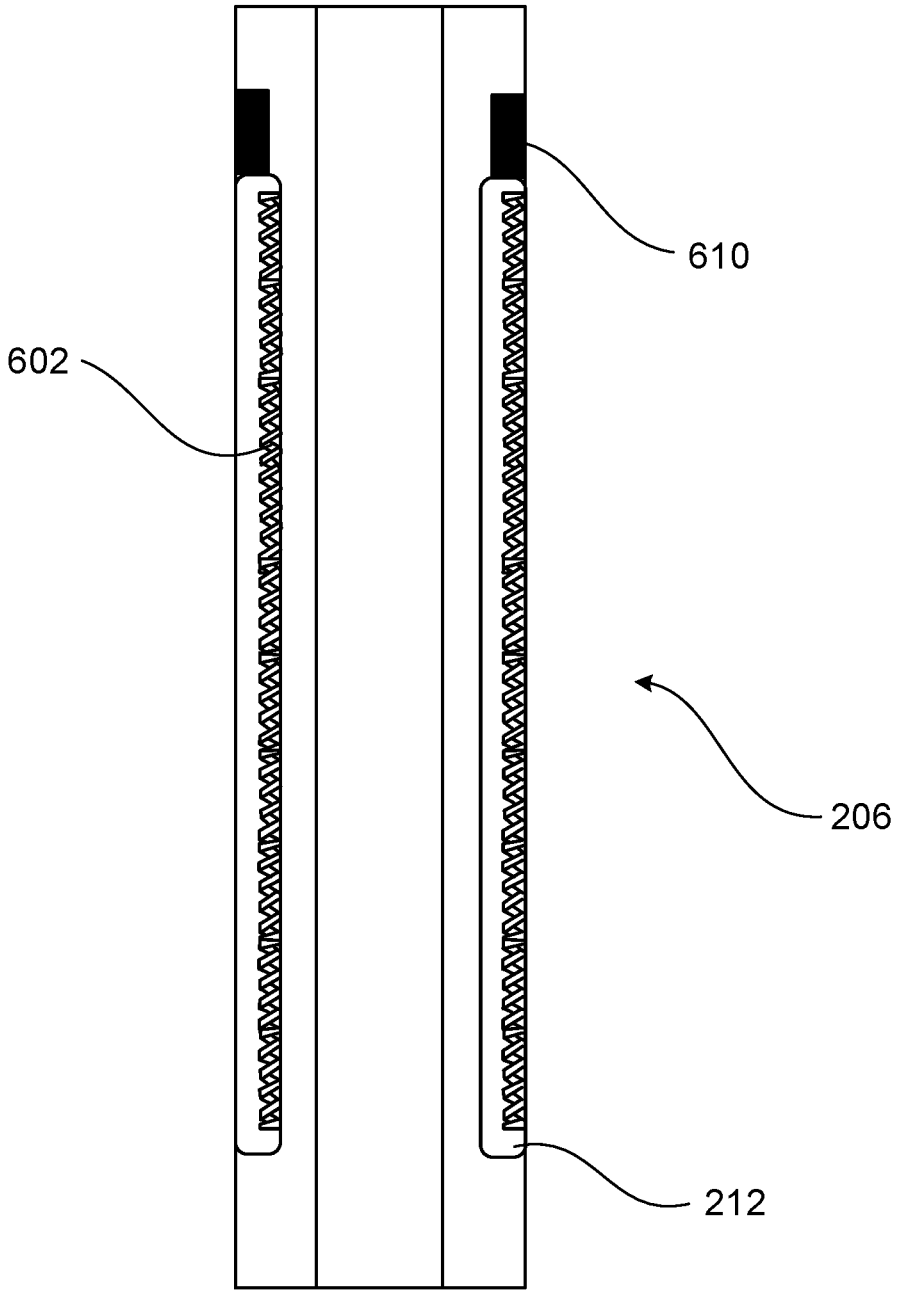
FIG. 6 shows a side cross-sectional view of an example magnetic module.

FIG. 6 shows an example cross-sectional view of an example magnetic sub-assembly 206. The magnetic sub-assembly 206 includes electromagnetic coils 602 within the electromagnetic bars 212. The electromagnetic coils 602 and electromagnetic bars 212 are activated when electric power is received from the control sub-assembly 101. The electric power supplied to the electromagnetic coils 602 creates a magnetic field in the electromagnetic coils 602 and the electromagnetic bars 212. The electromagnetic coils 602 can remain energized during a well-trip so that any ferrous debris collected by the magnetic sub-assembly 206 can be removed from the wellbore and brought to the topside facility. The magnetic sub-assembly 206 can also include sensors 610 to relay back information to the control sub-assembly 101, such as current draw or temperature.

Figure 7:
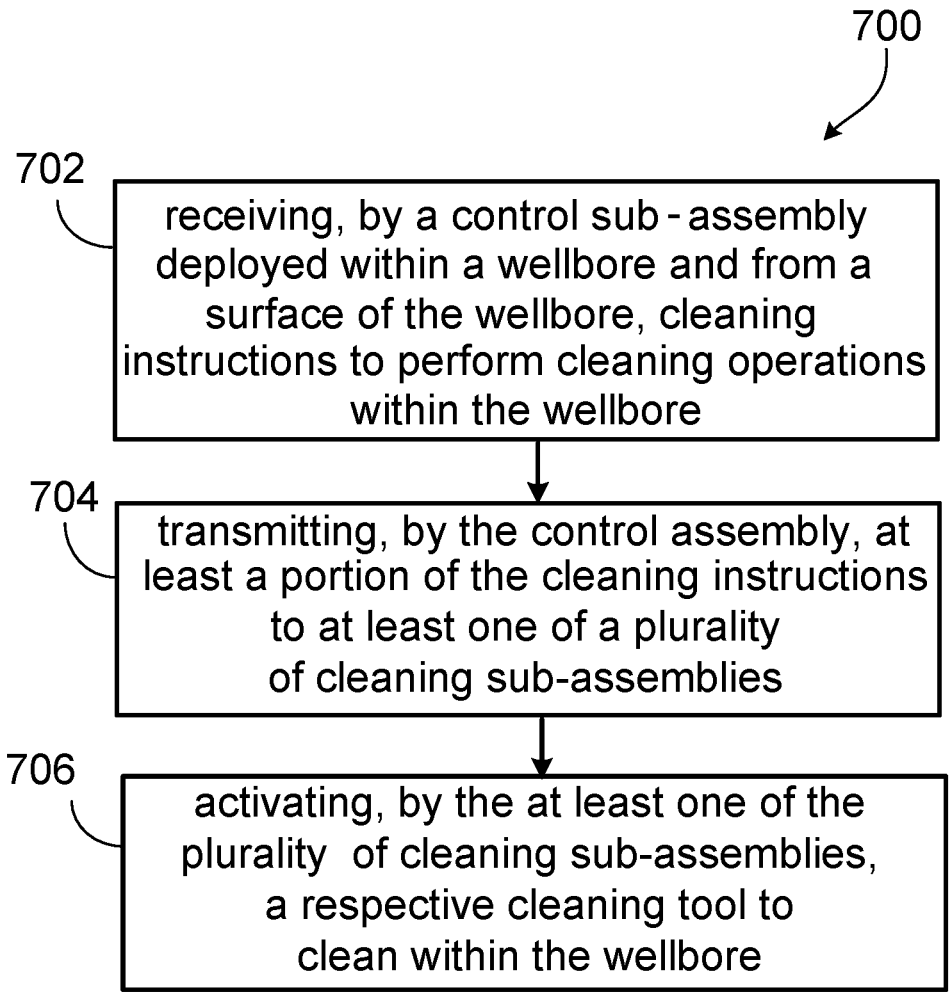
FIG. 7 is a flowchart showing an example method of controlling a cleaning module.

FIG. 7 shows a flowchart of an example method 700 that can be used to utilize the downhole cleaning system 100. At 702, cleaning instructions to perform cleaning operations within the wellbore 106 are received from a surface 116 of the wellbore 106 by a control sub-assembly 101 deployed within a wellbore 106. At 704, at least a portion of the cleaning instructions is transmitted by the control assembly to at least one of the cleaning sub-assemblies, such as the scraping sub-assembly 202, the brushing sub-assembly 204, or the magnetic sub-assembly 206. In some implementations, at least two of the previously mentioned sub-assemblies can be used within the BHA 102. Each of the cleaning sub-assemblies includes some form of cleaning tool that can clean within the wellbore, such as the scraping sub-assembly 202, the brushing sub-assembly 204, or the magnetic sub-assembly 206. At 706, a respective cleaning tool is activated by at least one of the cleaning sub-assemblies to clean within the wellbore 106. Additionally, status signals representing a cleaning status of the at least one of the cleaning sub-assemblies is transmitted by at least one of the cleaning sub-assemblies to the control assembly 101. The status signals from the at least one of cleaning sub-assemblies is received by the control sub-assembly 101. In some implementations the status signals from the at least one of the cleaning sub-assemblies is transmitted to the surface 116 of the wellbore 106 by the control sub-assembly 101.

Figure 8:
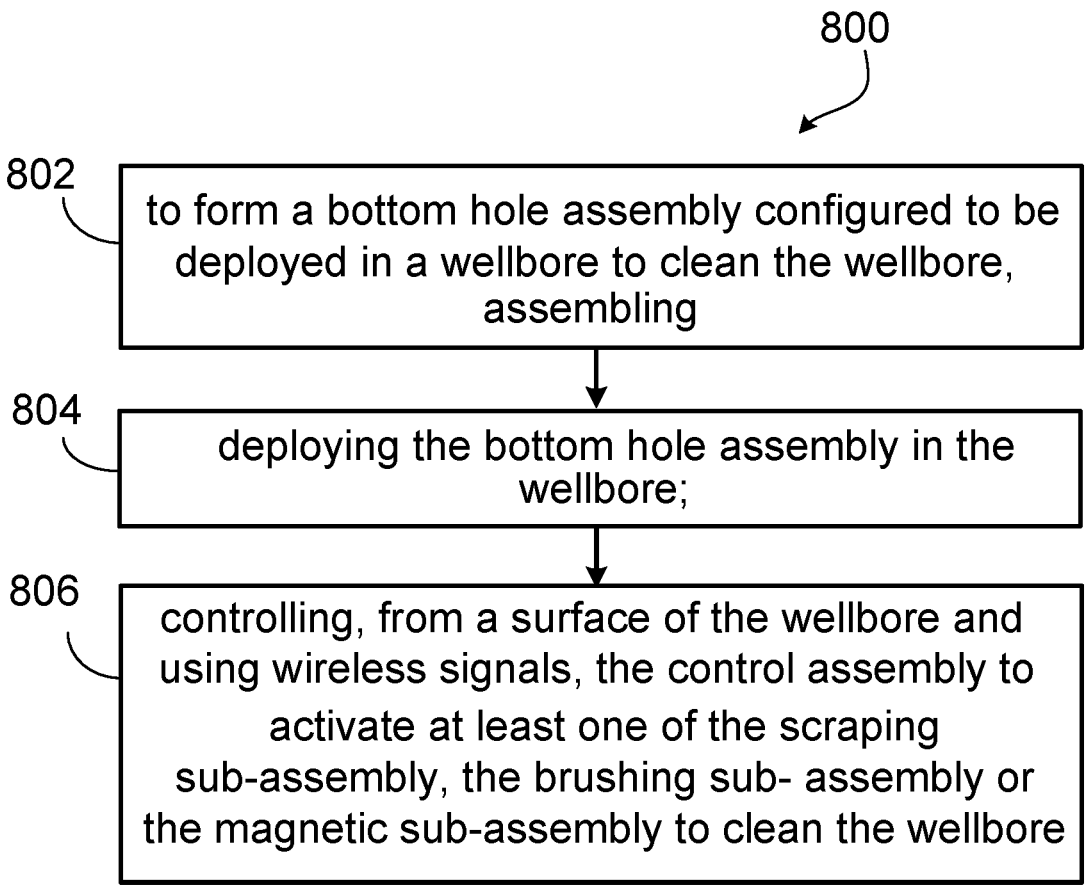
FIG. 8 is a flowchart showing an example method of cleaning a wellbore.

FIG. 8 shows a flowchart of an example method 800 that can be used to clean the wellbore 106. At 802, a BHA 102 that can be deployed in the wellbore 106 to clean the wellbore 106 is formed by assembling a control assembly 101 and at least one of the cleaning sub-assemblies previously described within this specification, such as the scraping sub-assembly 202, the brushing sub-assembly 204, or a magnetic sub-assembly 206. At 804, the BHA is deployed in the wellbore. At 806, the control sub-assembly 101 is controlled from the surface 116 of the wellbore 106 using wireless signals to activate at least one of the any of the cleaning sub-assemblies, such as the scraping sub-assembly 202, the brushing sub-assembly 204 or the magnetic sub-assembly 206 to clean the wellbore. In some implementations, at least two of the previously described cleaning modules are assembled together to form the BHA. In some implementations, the scraping sub-assembly 202, the brushing sub-assembly 204, and the magnetic sub-assembly 206, are all assembled together to form the BHA. In some implementations, status signals representing a status of cleaning operations can be received by the control sub-assembly 101 and from the at least one of the cleaning sub-assemblies, such as the scraping sub-assembly 202, the brushing sub-assembly 204, or the magnetic sub-assembly 206. In some implementations, the status signals can be wirelessly transmitted by the control sub-assembly 101 to the surface 116 of the wellbore. In some implementations, the repeater 114 can at least partially relay the wireless status signal. In some implementations, the status signals can include a state of the at least one of the previously described cleaning sub-assemblies, such as the scraping sub-assembly 202, the brushing sub-assembly 204, or the magnetic sub-assembly 206. The state can include either an "on" state or an "off" state. The state can also include a hydraulic pressure of the at least one of the cleaning sub-assemblies, such as the scraping sub-assembly 202, or the brushing sub-assembly 204.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A wellbore cleaning system comprising:

a bottom hole assembly configured to be run downhole into a drilled wellbore before the wellbore has been cleaned, wherein the wellbore comprises a cased or lined wellbore;

a control sub-assembly mounted on and carried by the bottom hole assembly, the control sub-assembly configured to be positioned within the wellbore, wherein the control subassembly comprises:

one or more processors; and a computer-readable medium storing instructions executable by the one or more processors to perform operations comprising:

receiving, from a surface of the wellbore, cleaning instructions to perform cleaning operations within the wellbore; and transmitting, to at least one of the plurality of cleaning sub-assemblies, at least a portion of the cleaning instructions; and a plurality of cleaning sub-assemblies interchangeably mounted on and carried by the bottom hole assembly, each cleaning sub-assembly configured to be positioned within the wellbore, the plurality of cleaning sub-assemblies comprising at least two of:

a scraping sub-assembly configured to scrape an interior of the wellbore, a brushing sub-assembly configured to brush the interior of the wellbore, or a magnetic sub-assembly configured to magnetically capture debris within the wellbore;

wherein each of the plurality of cleaning sub-assemblies comprises:

a hydraulic power unit operatively coupled to the one or more processors, the hydraulic power unit configured to receive at least the portion of the cleaning instructions from the one or more processors; and a cleaning tool operatively coupled to the hydraulic power unit, the hydraulic power unit configured to mechanically activate the cleaning tool, wherein the cleaning tool is configured to implement a cleaning operation within the wellbore responsive to being mechanically activated by the hydraulic power unit.

2. The system of claim 1, wherein the operations further comprise:

receiving, from at least one of the plurality of cleaning sub-assemblies, status signals representing a cleaning status of the at least one of the plurality of cleaning sub-assemblies; and transmitting, to the surface of the wellbore, the status signals.

3. The system of claim 2, wherein the status signals comprise a state of a cleaning sub-assembly, the state comprising either an on state or an off state, and a hydraulic pressure of the cleaning sub-assembly.

4. The system of claim 3, further comprising:

one or more transmitters at the surface of the wellbore, the one or more transmitters configured to transmit the cleaning instructions to the one or more processors; and one or more receivers at the surface of the wellbore, the one or more receivers configured to receive the status signals from the one or more processors.

5. The system of claim 4, wherein the one or more transmitters and the one or more receivers are configured to communicate wirelessly with the one or more processors.

6. The system of claim 5, further comprising one or more repeaters configured to be positioned between the surface and the bottom hole assembly within the wellbore, the one or more repeaters configured to boost a strength of a wireless signal between the one or more transmitters or the one or more receivers and the one or more processors.

7. The system of claim 1, wherein the control sub-assembly further comprises a power source configured to be positioned within the wellbore, the power source operatively coupled to the one or more processors, the power source configured to provide operating power to the one or more processors.

8. The system of claim 7, wherein the power source is a stand-alone power source.

9. The system of claim 1 further comprising a smart sub-assembly configured to receive, from at least one of the plurality of cleaning sub-assemblies, status signals representing a cleaning status of the at least one of the plurality of cleaning sub-assemblies.

10. The system of claim 1, wherein the hydraulic power unit comprises a hydraulic pump fluidically connected to the cleaning tool, the hydraulic pump configured to supply hydraulic fluid at a pressure sufficient to activate the cleaning tool.

11. A method of cleaning a wellbore, the method comprising:

receiving, by a control sub-assembly deployed within a wellbore and from a surface of the wellbore, cleaning instructions to perform cleaning operations within the wellbore;

transmitting, by the control assembly, at least a portion of the cleaning instructions to at least one of a plurality of cleaning sub-assemblies comprising at least two of:

a scraping sub-assembly configured to scrape an interior of the wellbore, a brushing sub-assembly configured to brush the interior of the wellbore, or a magnetic sub-assembly configured to magnetically capture debris within the wellbore, wherein each of the plurality of cleaning sub-assemblies comprises a cleaning tool configured to clean within the wellbore; and activating, by the at least one of the plurality of cleaning sub-assemblies, a respective cleaning tool to clean within the wellbore, wherein each cleaning sub-assembly comprises a respective hydraulic power unit comprising a hydraulic pump, wherein activating, by the at least one of the plurality of cleaning sub-assemblies, the respective cleaning tool to clean within the wellbore comprises pumping, by the hydraulic pump, hydraulic fluid to mechanically activate the respective cleaning tool.

12. The method of claim 11, further comprising:

transmitting, by the at least one of the plurality of cleaning sub-assemblies to the control assembly, status signals representing a cleaning status of the at least one of the plurality of cleaning sub-assemblies; and receiving, by the control assembly, the status signals from the at least one of the plurality of cleaning sub-assemblies.

13. The method of claim 12, further comprising transmitting, by the control assembly to the surface of the wellbore, the status signals from the at least one of the plurality of cleaning sub-assemblies.

14. A method comprising:

forming a bottom hole assembly configured to be deployed in a wellbore to clean the wellbore by assembling:

a control assembly comprising one or more processors and a computer-readable medium storing instructions executable by the one or more processors to clean the wellbore; and at least two of a scraping sub-assembly configured to scrape an interior of the wellbore, a brushing sub-assembly configured to brush the interior of the wellbore, or a magnetic sub-assembly configured to magnetically capture debris within the wellbore;

deploying the bottom hole assembly in the wellbore; and controlling, from a surface of the wellbore and using wireless signals, the control assembly to activate a respective hydraulic power unit of at least one of the scraping sub-assembly, the brushing sub-assembly or the magnetic sub-assembly to clean the wellbore, wherein the respective hydraulic power unit comprises a respective hydraulic pump, wherein activating the respective hydraulic power unit comprises pumping, by the respective hydraulic pump, hydraulic fluid to mechanically activate the at least one of the scraping sub-assembly, the brushing sub-assembly or the magnetic sub-assembly.

15. The method of claim 14, further comprising forming the bottom hole assembly by assembling the scraping sub-assembly, the brushing sub-assembly and the magnetic sub-assembly.

16. The method of claim 14, further comprising:

receiving, by the control assembly and from the at least one of the scraping sub-assembly, the brushing sub-assembly or the magnetic sub-assembly, status signals representing a status of cleaning operations; and wirelessly transmitting, by the control assembly and to the surface of the wellbore, the status signals.

17. The method of claim 16, wherein the status signals comprise a state of the at least one of the scraping sub-assembly, the brushing sub-assembly or the magnetic sub-assembly, the state comprising either an on state or an off state, and a hydraulic pressure of the respective hydraulic pump of the respective hydraulic power unit of the at least one of the scraping sub-assembly, the brushing sub-assembly or the magnetic sub-assembly.

* * * * *